US007261336B2

(12) United States Patent
Zillert

(10) Patent No.: US 7,261,336 B2
(45) Date of Patent: Aug. 28, 2007

(54) MOTOR VEHICLE LOCK

(75) Inventor: Markus Zillert, Duesseldorf (DE)

(73) Assignee: Brose Schliessysteme GmbH & Co. KG, Wuppertal (DE)

( * ) Notice: Subject to any disclaimer, the term of this patent is extended or adjusted under 35 U.S.C. 154(b) by 89 days.

(21) Appl. No.: 11/180,592

(22) Filed: Jul. 14, 2005

(65) Prior Publication Data

US 2006/0012186 A1 Jan. 19, 2006

(30) Foreign Application Priority Data

Jul. 15, 2004 (DE) ..... 10 2004 034 510

(51) Int. Cl.
*E05C 3/06* (2006.01)

(52) U.S. Cl. ..... 292/201; 49/280

(58) Field of Classification Search ..... 292/201; 49/280

See application file for complete search history.

(56) References Cited

U.S. PATENT DOCUMENTS 5,232,253 A * 8/1993 Tamiya ..... 292/201
5,433,496 A 7/1995 Zimmermann
5,516,164 A 5/1996 Kobayashi
5,829,198 A * 11/1998 Watanabe ..... 49/280
6,003,910 A * 12/1999 Dupont et al. ..... 292/201
6,685,239 B2 * 2/2004 Yamauchi et al. ..... 292/201
2004/0174021 A1 9/2004 Tensing et al.

FOREIGN PATENT DOCUMENTS

DE 34 14 475 C1 12/1985
DE 101 33 092 A1 1/2003
FR 2 768 761 A1 3/1999
WO WO 03/071064 A1 8/2003

* cited by examiner

*Primary Examiner*—Gary Estremsky
(74) *Attorney, Agent, or Firm*—David S. Safran

(57) ABSTRACT

A motor vehicle lock with a latch, a ratchet, an optional preliminary catch and a closing aid, the closing aid having an auxiliary closing drive with a pivoting driving element and an auxiliary closing lever which is pivotably coupled to the driving element. The latch can be moved by means of the auxiliary closing drive via the driving element and via the auxiliary closing lever into the fully latched position—closing process—and for this purpose, the auxiliary closing lever can be coupled to the latch. The driving element can be caused to engage the auxiliary closing lever such that the cycle of movements of the driving element, after the latch moves into the fully latched position, causes decoupling of the auxiliary closing lever from the latch.

16 Claims, 4 Drawing Sheets

MOTOR VEHICLE LOCK

BACKGROUND OF THE INVENTION

1. Field of Invention

This invention relates to a motor vehicle lock with a latch, a ratchet which keeps the latch in a main catch, and an optionally present preliminary catch, and also having a closing aid, the closing aid having a drive—auxiliary closing drive—with a pivoting driving element and an auxiliary closing lever which is pivotably coupled to the driving element. The latch can be moved by means of the auxiliary closing drive via the driving element and via the auxiliary closing lever into a fully latched position—closing process—and for this purpose, the auxiliary closing lever can be coupled to the latch, and the closing process comprising a cycle of movements of the driving element. The motor vehicle lock is especially well suited to be a side door lock, but can also be used as a sliding door lock, rear door lock, rear hatch lock or a hood lock.

2. Description of Related Art

To increase ease of operation and to be able to reproducibly ensure an optimum closing process, motor vehicle locks are being increasingly equipped with an auxiliary closing function. The auxiliary closing function provides for the motor vehicle lock being transferred out of an intermediate position by a motor into the fully closed position. The intermediate position in a motor vehicle lock with a latch and ratchet corresponds generally to the half-latched position of the latch.

In a known motor vehicle lock (U.S. Pat. No. 5,516,164), to implement the auxiliary closing function, there are an auxiliary closing drive and an auxiliary closing lever in order to move the latch of the motor vehicle lock from the half-latched position into the fully latched position. In this closing process, the auxiliary closing lever engages a recess which is located on the latch, presses the latch into the fully latched position, and finally remains in a position in which the auxiliary closing lever blocks the resetting of the latch. Only when the ratchet is lifted, therefore when the motor vehicle door is to be opened, does the auxiliary closing lever disengage from the latch. The lifting of the auxiliary closing lever, therefore the decoupling of the auxiliary closing lever from the latch, is directly associated here with the lifting of the ratchet. This is implemented by an additional lever mechanism which requires high construction input.

Furthermore, a motor vehicle lock is known (U.S. Pat. No. 5,433,496) in which the ratchet itself is used as the auxiliary closing lever. Here, there is a lever mechanism which, on the one hand, enables movement of the latch into the fully latched position by means of the ratchet, and on the other hand, the raising of the ratchet itself. This design is complex and has disadvantages with respect to a flexible arrangement of the diverse parts in the motor vehicle lock.

The known motor vehicle lock underlying the invention (WO 03/071064 A1) is, likewise, equipped with a motorized closing aid. The closing aid has an auxiliary closing drive with a pivoting driving element and an auxiliary closing lever which is coupled with a pivoting capacity to the driving element. The auxiliary closing lever has a crank guide which can be engaged to an intermediate element. The crank guide thus causes guidance of the motion of the auxiliary closing lever such that the auxiliary closing lever is coupled to the latch at the start of the closing process and at the end of the closing process is decoupled from the latch.

In the motor vehicle lock which forms the starting point, the disadvantage is the fundamental fault susceptibility of the described crank guide. Here frictional losses or sticking can occur. Furthermore, it is disadvantageous that the components required here, especially the crank guide itself, are complex to fabricate. Finally it should be pointed out that basically the necessary coupling between the auxiliary closing lever and the intermediate element must be considered in the design; this leads to unwanted construction limitations.

SUMMARY OF THE INVENTION

A primary object of this invention is to embody and develop the known motor vehicle lock such that high operating reliability is ensured with high construction flexibility and with low complexity.

This object is achieved in a motor vehicle lock of the initially mentioned type in which the driving element can be caused to engage the auxiliary closing lever such that the cycle of movements of the driving element, after the latch moves into the fully latched position, causes decoupling of the auxiliary closing lever from the latch.

An important finding is that suitable coupling between the driving element and the auxiliary closing lever can cause the cycle of movements of the driving element to effect decoupling of the auxiliary closing lever from the latch after moving the latch into the fully latched position.

The auxiliary closing drive, to a certain extent with the auxiliary closing lever, forms a closed system which can perform its function, aside from coupling to the latch, largely independently of other components of the motor vehicle lock. This leads to structural decoupling, and as a result, to especially simple construction approaches.

The structural configuration is especially simple, and thus durable, when the auxiliary closing lever is coupled to the driving element at a site which is spaced away from the pivoting axis of the driving element, in the manner of a cam. Then, simply a stop on the driving element and a corresponding opposing stop on the auxiliary closing lever are necessary to be able to effect decoupling of the auxiliary closing lever from the latch by the cycle of movements of the driving element.

At the start of the closing process, the stop and the opposing stop are engaged with one another and block the pivoting of the auxiliary closing lever relative to the driving element in one direction. In this way, it is first ensured that the auxiliary closing lever cannot intervene in the motion of the latch as long as this is not wanted.

The closing aid is preferably made such that the auxiliary closing lever, in the closing process, comes into contact with the latch by the cycle of movements of the driving element, and when the stop and opposing stop are engaged with one another, first without pivoting relative to the driving element and then causing the corresponding movement of the latch as pivoting proceeds relative to the driving element.

Furthermore, it is quite preferred that the stop and the opposing stop be made such that, in the closing process and after movement of the latch, they engage one another by the cycle of movements of the driving element such that decoupling of the auxiliary closing lever takes place. This means that the motion of the driving element is transmitted by way of the stops to the auxiliary closing lever such that the latter is released from the position which couples with the latch.

Using extremely simple construction means the full operating scope of the closing aid is ensured, including coupling of the auxiliary closing lever to the latch and decoupling of the auxiliary closing lever from the latch.

Other details, features, objectives and advantages of this invention are explained in detail below using the drawings which show preferred embodiments of the invention.

DETAILED DESCRIPTION OF THE INVENTION

In the figures of the drawings, the same reference numbers are used for the same or similar parts. This is intended to indicate that the corresponding or comparable properties and advantages are achieved even if a repeated description of these parts is omitted.

Figure 1:
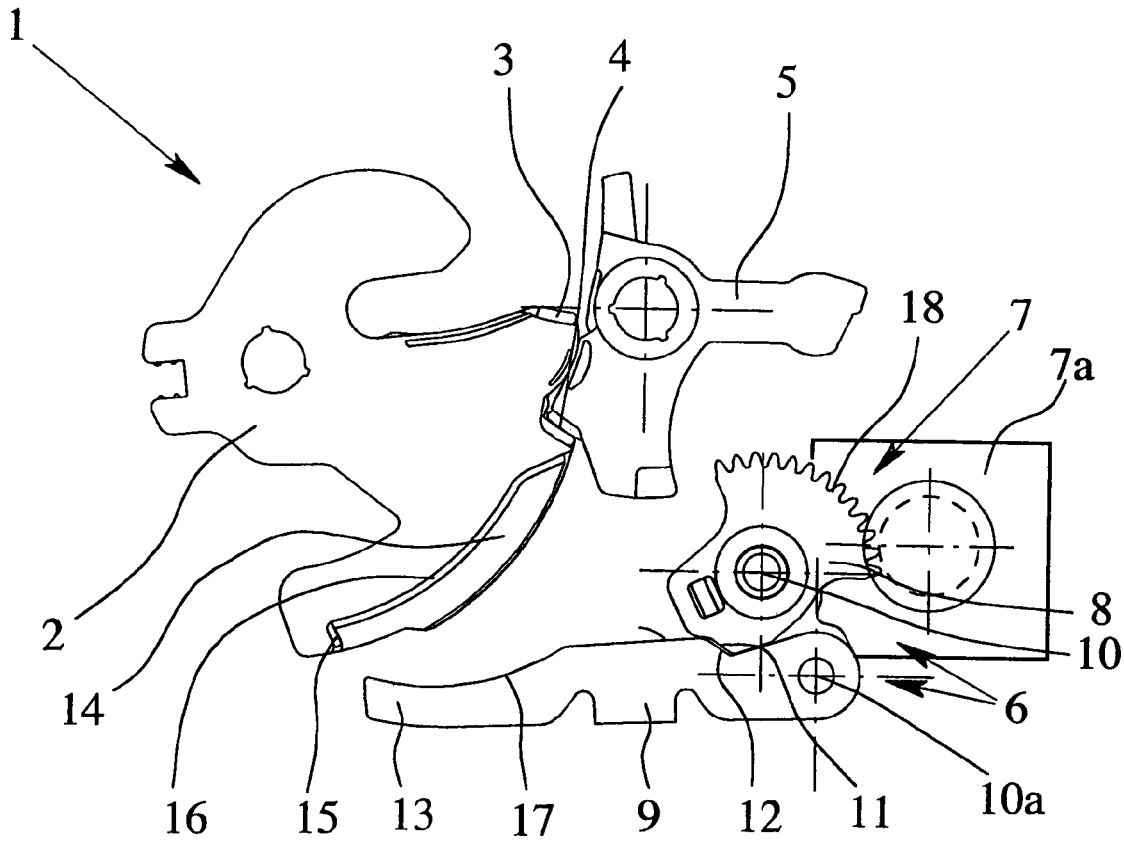
FIG. 1 shows a motor vehicle lock in accordance with the invention with the latch in the half-latched position and the auxiliary closing lever decoupled.

FIG. 1 shows a motor vehicle lock 1 with a latch 2 and a ratchet 5 which holds the latch 2 in a main catch 3 or a preliminary catch 4. In FIG. 1, the latch 2 is in the half-latched position in which the latch 2 is held in the preliminary catch 4 by the ratchet 5. In the fully latched position, the latch 2 is held by the ratchet 5 in the main catch 3. For the invention disclosed here, a half-latched position is not absolutely necessary. Instead, a defined intermediate position is sufficient from which the latch 2 then can be moved into its fully latched position. However, in the embodiment described here, the intermediate position corresponds to the half-latched position.

The motor vehicle lock 1 is equipped with a closing aid 6 for moving the latch 2 into the fully latched position. In doing so, both motorized and also manual operation of the closing aid are possible. The closing aid 6 has a drive 7, the auxiliary closing drive, with a driving element 8 and an auxiliary closing lever 9. The driving element 8 is supported to be able to pivot around a pivot axis 10. The auxiliary closing lever 9 is coupled to the driving element 8 with a capacity to pivot around the pivoting axis 10*a*. The pivoting axis 10 of the driving element 8 and the pivoting axis 10*a* of the auxiliary closing lever 9 are preferably oriented parallel to one another.

Figure 2:
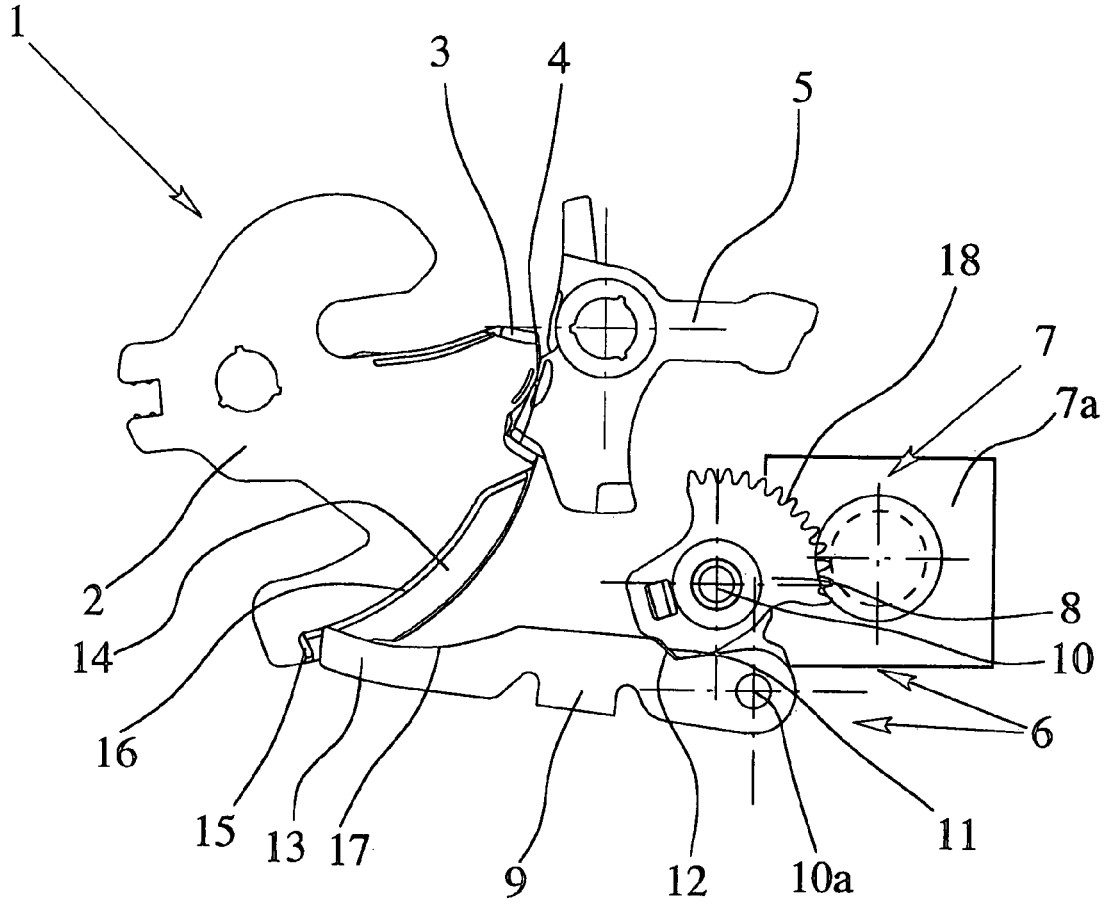
FIG. 2 shows the motor vehicle lock from FIG. 1 with the auxiliary closing lever coupled.

The latch 2 can be moved by means of the auxiliary closing drive 7 via the driving element 8 and via the auxiliary closing lever 9 into the fully latched position. For this reason, the auxiliary closing lever 9 can be coupled to the latch 2 (FIG. 2). The movement of the latch 2 into the fully latched position is called the closing process.

Figure 3:
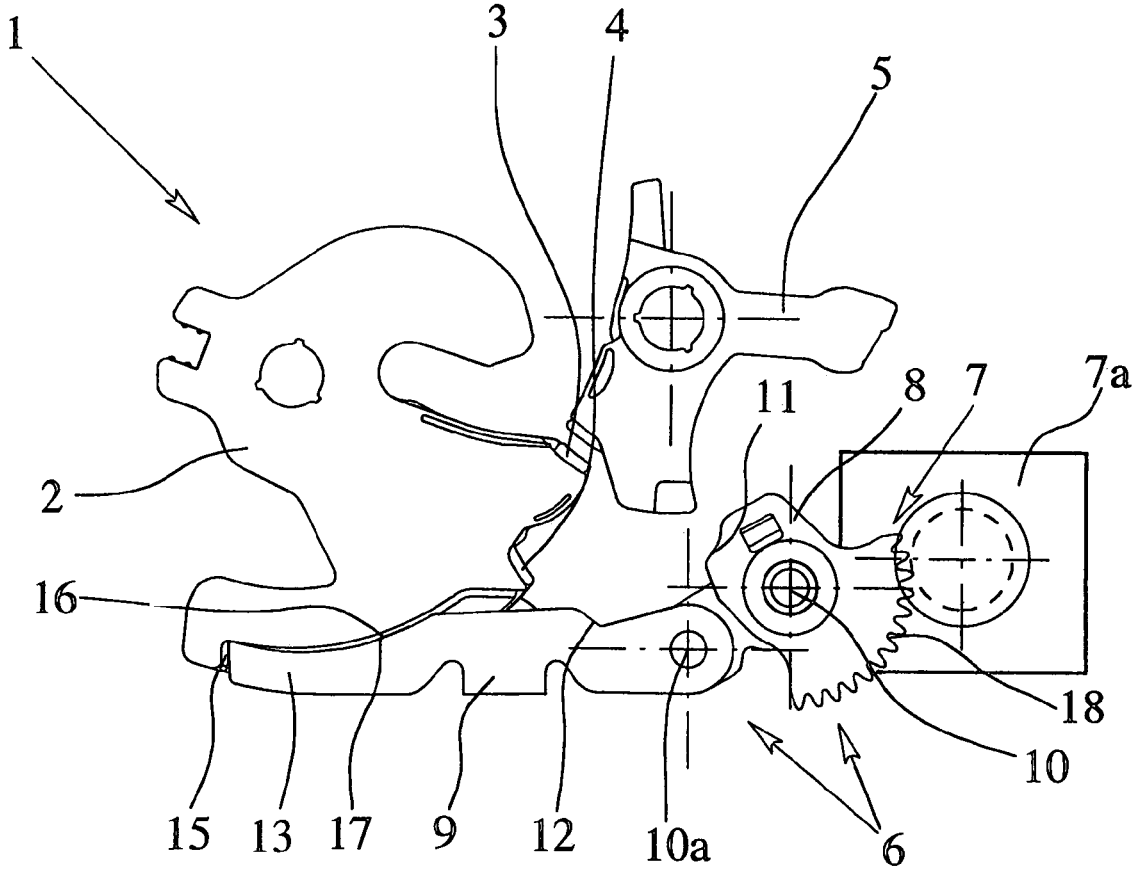
FIG. 3 shows the motor vehicle lock from FIG. 1 with the latch in the overtravel position.

The closing process of the latch 2 comprises a cycle of movement of the driving element 8 which causes movement of the latch 2 into the fully latched position and then decoupling of the auxiliary closing lever 9 from the latch 2. The movement of the latch 2 into the fully latched position here also comprises the movement of the latch 2, first into an overtravel position (FIG. 3), with the latch 2 subsequently dropping back into the fully latched position. The closing process is completed only after decoupling of the auxiliary closing lever 9 from the latch 2.

It is pointed out here that the special configuration of the coupling between the driving element 8, on the one hand, and the auxiliary closing lever 9, on the other, causes the decoupling of the auxiliary closing lever 9 from the latch 2 by the cycle of movements of the driving element 8. This is explained in further detail below.

The closing aid 6 is made here such that the cycle of movements of the driving element 8 before the latch 2 moves into the fully latched position first causes coupling of the auxiliary closing lever 9 to the latch 2.

The cycle of movements of the driving element 8 in the closing process preferably comprises pivoting of the driving element 8 in the two pivoting directions. Here, the coupling of the auxiliary closing lever 9 with the latch 2 and the movement of the latch 2 into the fully latched position are associated with the pivoting of the driving element 8 in one pivoting direction, in FIG. 1, around to the right, and decoupling is associated with pivoting of the driving element 8 in the opposite direction of pivoting, in FIG. 1, around to the left.

The entire closing process takes place preferably in a completely motorized manner. However, it is also possible for the resetting of the driving element 8, and thus, the decoupling of the auxiliary closing lever 9 to be accomplished by spring force in conjunction with free-running of the driving element 8.

The auxiliary closing lever 9 is pivotably coupled to the driving element 8, preferably in the manner of a cam, at a site which is spaced away from the pivot axis 10 of the driving element 8. The driving element 8 has a stop 11 and the auxiliary closing lever 9 has an opposing stop 12. The two stops 11, 12, at the start of the closing process, engage one another and block pivoting of the auxiliary closing lever 9 relative to the driving element 8 in one direction, here in the direction of the coupled position of the auxiliary closing lever 9.

The closing aid 6 is preferably made such that the auxiliary closing lever 9, in the closing process, first comes into contact with the latch 2 by the cycle of movements of the driving element 8, and when the stop 11 and the opposing stop 12 are engaged to one another, without pivoting relative to the driving element 8. This is associated with pivoting of the driving element 8 around to the right in FIG. 1. Then, the further pivoting of the driving element 8 causes movement of the latch 2 into the fully latched position as the auxiliary closing lever 9 pivots relative to the driving element 8.

The stop 11 and the opposing stop 12 are arranged such that, in the closing process and after movement of the latch 2 into the fully latched position, by the cycle of movements of the driving element 8, they are caused to engage one another such that, in this way, decoupling of the auxiliary closing lever 9 from the latch 2 takes place. In doing so, in the embodiment shown here, the driving element 8 is pivoted, in FIG. 3 around to the left, until the stop 11 and the opposing stop 12 in turn engage one another. Further pivoting of the driving element 8 then results in joint pivoting of the driving element 8 and the auxiliary closing lever 9, by the blocking engagement of the stops 11, 12, until ultimately the initial position (FIG. 1) is reached again.

The driving element 8 and the auxiliary closing lever 9 are pretensioned into the position which they block one another. This takes place, preferably, by a correspondingly arranged spring. Due to pretensioning, the stop 11 and the opposing stop 12 are in blocking engagement as long as there is no force acting against the pretensioning. This force takes effect only when the auxiliary closing lever 9 is coupled to the latch 2 and as long as the auxiliary closing lever 9 is coupled to the latch 2.

The driving element 8, the auxiliary closing lever 9 and the latch 2 produce four-bar kinematics in the closing process. This is especially advantageous with respect to the actuating forces for moving the latch 2 into the fully latched position, since a favorable transmission ratio can be achieved by the four-bar kinematics with little effort.

The four-bar kinematics, here, are the kinematics between the driving element 8 and the latch 2 in which, during the closing process, four joints are involved. Here, they are the pivot axis 10 of the driving element 8, the coupling point of the auxiliary closing lever 9 to the driving element 8, the coupling of the auxiliary closing lever 9 to the latch 2, and the pivot axis of the latch 2. However, the four-bar kinematics are not critical; instead of it, there can also be other kinematic chains between the driving element 8 and the latch 2. In particular, instead of the four-bar kinematics, kinematics with more than four joints can be provided which, with respect to the transmission ratio, is possibly more favorable, but requires a greater construction effort.

The auxiliary closing lever 9 has a bolt 13 and the latch 2 has a recess 14. In the closing process, the bolt 13 engages the recess 14 of the latch 2 for coupling the auxiliary closing lever 9 to the latch 2. The recess 14, for this purpose, has an essentially radially oriented section 15 with which the bolt 13 of the auxiliary closing lever 9 engages when the latch 2 is pivoted for transmission of force.

In addition, the recess 14 has an essentially arc-shaped section 16 which is approached by the auxiliary closing lever 9 during the closing process. Accordingly, the auxiliary closing lever 9 is also equipped with an arc-shaped section 17 which corresponds to the section 16 of the recess 14.

When the auxiliary closing lever 9 is decoupled from the latch 2, the auxiliary closing lever 9 slides along the arc-shaped section 16 of the latch 2 until the stops 11, 12 engage one another and the auxiliary closing lever 9 is then decoupled by the continued motion of the driving element 8.

The auxiliary closing lever 7, here, preferably has an electric motor 7*a* (FIGS. 1 to 3) for moving the driving element 8. However, instead of the electric motor, there can also be a pneumatic drive or the like. For drive-engineering coupling, preferably to the motor, the driving element 8 preferably has a section 18 which is made as a toothed ring sector.

Figure 4:
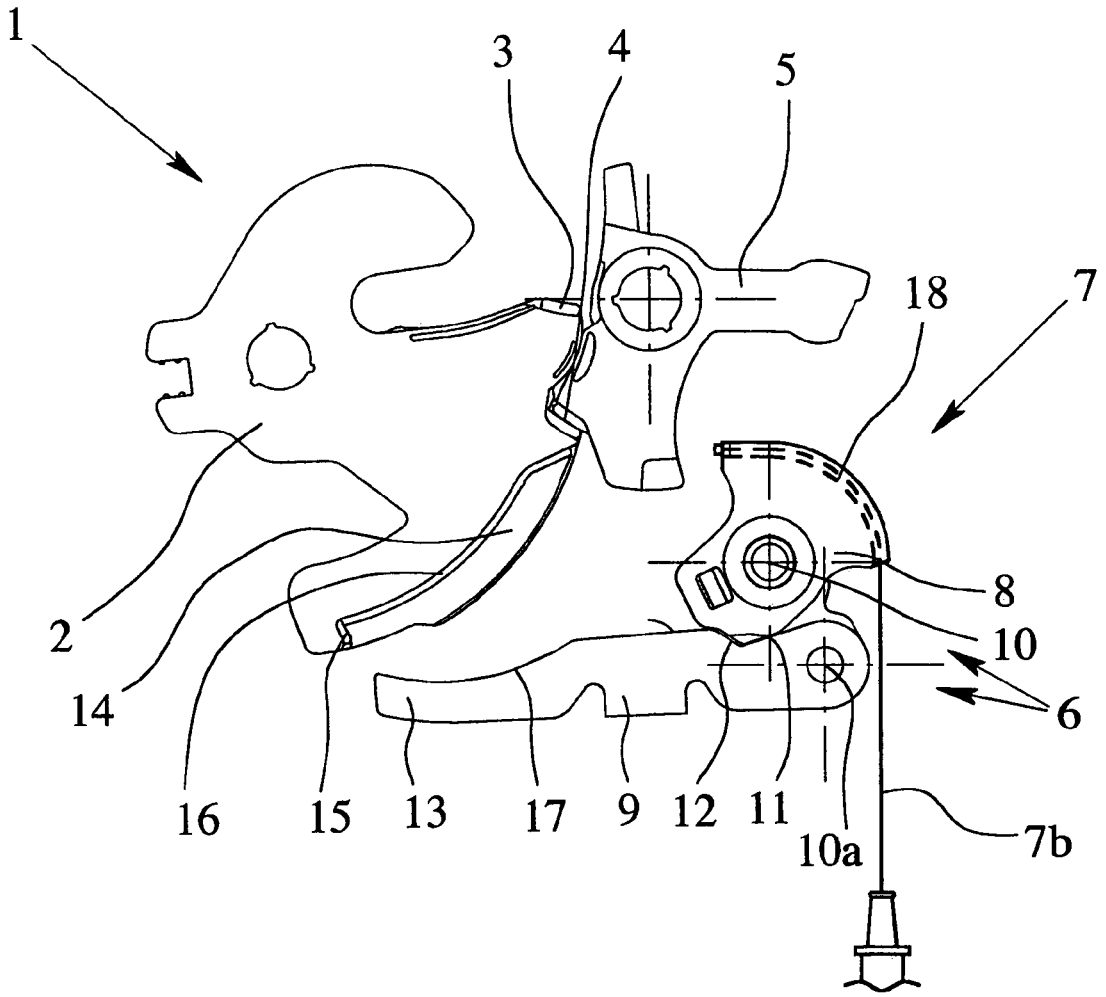
FIG. 4 shows a motor vehicle lock of the invention with the latch in the half-latched position and with the auxiliary closing lever decoupled according to another embodiment.

However, the auxiliary closing lever 7 can also have a Bowden cable 7*b* (FIG. 4 embodiment) so that, by actuating the Bowden cable 7*b*, the driving element 8 is pivoted as described above. The pivoting of the driving element 8 can be implemented by the Bowden cable 7*b* being coupled directly to the driving element 8 itself, or by the Bowden cable 7*b* being coupled indirectly, for example via gearing, to the driving element 8. The Bowden cable 7*b* itself is actuated by a motorized drive, or manually.

What is claimed is:

1. Motor vehicle lock, comprising: a latch, a ratchet which is adapted for holding the latch in a main catch, and a closing aid, the closing aid having an auxiliary closing drive with a pivoting driving element and an auxiliary closing lever which is pivotably coupled to the driving element, the latch being movable by the auxiliary closing drive via the driving element and via the auxiliary closing lever into a fully latched position in a closing process comprising a cycle of movements of the driving element, wherein the driving element is engageable with the auxiliary closing lever in a manner decoupling the auxiliary closing lever from the latch due to the cycle of movements of the driving element after the latch moves into the fully latched position, wherein the auxiliary closing lever is pivotably coupled to the driving element at a site which is spaced away from a pivoting axis of the driving element, and wherein the driving element has a stop and the auxiliary closing lever has an opposing stop, and wherein pivoting of the auxiliary closing lever relative to the driving element is adapted to cause the stop and the opposing stop to engage one another so as to block further pivoting.

2. Motor vehicle lock as claimed in claim 1, further comprising a preliminary catch and wherein the ratchet is also adapted for holding the latch in the preliminary catch.

3. Motor vehicle lock as claimed in claim 1, wherein, in the closing process, the cycle of movements of the driving element for moving the latch into the fully latched position first causes coupling of the auxiliary closing lever to the latch.

4. Motor vehicle lock as claimed in claim 3, wherein, in the closing process, the cycle of movements of the driving element comprises pivoting of the driving element in two pivoting directions, coupling of the auxiliary closing lever with the latch and the movement of the latch into the fully latched position being associated with the pivoting of the driving element in a first pivoting direction, and decoupling of the auxiliary closing lever with the latch being associated with pivoting of the driving element in a second pivoting direction.

5. Motor vehicle lock as claimed in claim 1, wherein the stop and the opposing stop are engaged with one another in a blocking manner at the start of the closing process.

6. Motor vehicle lock as claimed in claim 5, wherein, in the closing process, the auxiliary closing lever first comes into contact with the latch due to the cycle of movements of the driving element, while the stop and the opposing stop are engaged with one another, and then causes movement of the latch as the auxiliary closing lever is pivoted relative to the driving element.

7. Motor vehicle lock as claimed in claim 1, wherein, in the closing process and after movement of the latch into the fully latched position, the stop and the opposing stop engage one another in a blocking manner by the cycle of movements of the driving element so as to produce decoupling of the auxiliary closing lever from the latch.

8. Motor vehicle lock as claimed in claim 1, further comprising means for pretensioning the driving element and the auxiliary closing lever into the position in which they block one another.

9. Motor vehicle lock as claimed in claim 1, wherein the driving element, the auxiliary closing lever and the latch, in the closing process, form an arrangement producing four-bar kinematics, and wherein the coupling between the auxiliary closing lever and the latch, in the closing process, along with the pivot axis of the driving element, a pivot of the auxiliary closing lever, and a pivot of the latch each form a joint of the arrangement producing four-bar kinematics.

10. Motor vehicle lock as claimed in claim 1, wherein the auxiliary closing lever has a bolt, wherein the latch has a recess and wherein the bolt, in the closing process, engages the recess for coupling of the auxiliary closing lever to the latch.

11. Motor vehicle lock as claimed in claim 10, wherein the recess has an essentially radially oriented section.

12. Motor vehicle lock as claimed in claim 10, wherein the recess has an essentially arc-shaped section which is approached by the auxiliary closing lever in the closing process.

13. Motor vehicle lock as claimed in claim 1, wherein the auxiliary closing drive is a motorized drive.

14. Motor vehicle lock as claimed in claim 13, wherein the motorized drive comprises an electric motor for moving the driving element.

15. Motor vehicle lock as claimed in claim 14, wherein the driving element has a section which has a toothed ring for coupling to the motor.

16. Motor vehicle lock as claimed in claim 1, wherein the auxiliary closing drive has a Bowden cable for pivoting the driving element by actuation of the Bowden cable.

* * * * *